US007764111B2

(12) United States Patent
Chiu et al.

(10) Patent No.: US 7,764,111 B2
(45) Date of Patent: Jul. 27, 2010

(54) CPU CORE VOLTAGE SUPPLY CIRCUIT

(75) Inventors: Yi-Wen Chiu, Taipei (TW); Chih-Wan Hsu, Taipei (TW); Hsi-Ho Hsu, Taipei (TW)

(73) Assignee: Asustek Computer Inc., Taipei (TW)

( * ) Notice: Subject to any disclaimer, the term of this patent is extended or adjusted under 35 U.S.C. 154(b) by 0 days.

(21) Appl. No.: 12/238,126

(22) Filed: Sep. 25, 2008

(65) Prior Publication Data

US 2009/0167423 A1 Jul. 2, 2009

(30) Foreign Application Priority Data

Dec. 26, 2007 (TW) ..... 96150335 A

(51) Int. Cl.
*G05F 1/10* (2006.01)

(52) U.S. Cl. ..... 327/540

(58) Field of Classification Search ..... 327/538, 327/540, 541, 543

See application file for complete search history.

(56) References Cited

U.S. PATENT DOCUMENTS 4,990,847 A * 2/1991 Ishimaru et al. ..... 323/314
5,373,226 A * 12/1994 Kimura ..... 323/313
5,485,117 A * 1/1996 Furumochi ..... 327/538
5,929,696 A * 7/1999 Lim et al. ..... 327/540
6,285,246 B1 * 9/2001 Basu ..... 327/541
6,377,033 B2 * 4/2002 Hsu ..... 323/274
6,456,155 B2 * 9/2002 Takai ..... 327/541
6,459,554 B1 * 10/2002 Meiners et al. ..... 361/63
6,650,175 B2 * 11/2003 Messager ..... 327/541
6,664,765 B2 * 12/2003 Dotzler et al. ..... 320/162
6,809,576 B1 * 10/2004 Yamasaki ..... 327/540
6,975,164 B1 * 12/2005 Matsui et al. ..... 327/541
7,221,213 B2 * 5/2007 Lee et al. ..... 327/541
7,400,051 B2 * 7/2008 Pang ..... 290/1 R
7,439,798 B2 * 10/2008 Kouno et al. ..... 327/541
7,480,587 B2 * 1/2009 Cancel ..... 702/132
7,498,855 B2 * 3/2009 Kitajima ..... 327/143

* cited by examiner

*Primary Examiner*—Jeffrey S Zweizig
(74) *Attorney, Agent, or Firm*—Kirton & McConkie; Evan R. Witt

(57) ABSTRACT

A CPU core voltage supply circuit includes a reference voltage generator, a differential operation amplifier, a power element, a feedback circuit and a first capacitor. The reference voltage generator outputs a first reference voltage. The differential operation amplifier has a positive input end, a negative input end and an output end. The positive input end is connected to the reference voltage generator for receiving the first reference voltage. The power element has a receiving terminal and a current output terminal. The receiving terminal is connected to the output end of the differential operation amplifier. The feedback circuit is connected to the current output terminal and outputs a feedback voltage to the negative input end of the differential operation amplifier. The first capacitor has an end connected to the current output terminal of the power element and the other end receiving a first voltage, thereby providing a CPU core voltage.

8 Claims, 3 Drawing Sheets

CPU CORE VOLTAGE SUPPLY CIRCUIT

FIELD OF THE INVENTION

The present invention relates to a CPU core voltage supply circuit, and more particularly to a CPU core voltage supply circuit with low power consumption.

BACKGROUND OF THE INVENTION

A motherboard of a notebook computer is generally provided with a central processing unit (CPU) platform, a chipset and some peripheral circuits. As known, Intel and AMD are two of the most important manufacturers of CPU platforms. Currently, the motherboards and the chipsets of the systematic companies are designed according to the specifications provided by the CPU manufacturers. In other words, the systematic companies have no choice but to comply with these stringent specifications, including the voltage specifications.

Conventionally, a CPU core voltage switching circuit is provided by the CPU manufacturer to produce various voltages. After the chipset is communicated with a specified CPU platform, the chipset will realize the working voltage required for the operating CPU platform according to the information registered on the CPU platform by the CPU manufacturer. Consequently, the CPU core voltage switching circuit offers the desired working voltage to the CPU platform.

The CPU core voltage switching circuit, however, has some drawbacks. For example, after the desired working voltage is selected from the various voltages, the rejected voltages are not used. Since only one working voltage is desired, the function of producing various voltages cause extra cost. Recently, a project of producing hundred-dollar laptop computers has been proposed by Massachusetts Institute of Technology and a low-cost netbook computer Eee PC has been designed by ASUSTeK Computer Inc. For producing these cheap educational devices, any measure to cost down will be well received.

Therefore, there is a need of providing a CPU core voltage supply circuit to obviate the drawbacks encountered from the prior art.

SUMMARY OF THE INVENTION

The present invention provides a CPU core voltage supply circuit in replace of using constant voltage switching circuit provided by the CPU manufacturers.

The present invention also provides a CPU core voltage supply circuit having simplified circuit configuration without deteriorating the performance.

In an embodiment, the CPU core voltage supply circuit includes a reference voltage generator, a differential operation amplifier, a power element, a feedback circuit and a first capacitor. The reference voltage generator outputs a first reference voltage. The differential operation amplifier has a positive input end, a negative input end and an output end. The positive input end of the differential operation amplifier is connected to the reference voltage generator for receiving the first reference voltage. The power element has a receiving terminal and a current output terminal. The receiving terminal of the power element is connected to the output end of the differential operation amplifier. The feedback circuit is connected to the current output terminal of the power element and outputs a feedback voltage to the negative input end of the differential operation amplifier. The first capacitor has an end connected to the current output terminal of the power element and the other end receiving a first voltage, thereby providing a CPU core voltage.

In a further embodiment, the CPU core voltage supply circuit includes a reference voltage generator, a control transistor, a differential operation amplifier, a power element, a feedback circuit, a first capacitor, a load resistor and an over-current comparator. The reference voltage generator outputs a first reference voltage and a second reference voltage. The control transistor has a first terminal receiving the first reference voltage. The differential operation amplifier has a positive input end, a negative input end and an output end. The positive input end of the differential operation amplifier is connected to a second terminal of the control transistor. The power element has a receiving terminal and a current output terminal. The receiving terminal of the power element is connected to the output end of the differential operation amplifier. The feedback circuit is connected to the current output terminal of the power element and outputs a feedback voltage to the negative input end of the differential operation amplifier. The first capacitor has an end connected to the current output terminal of the power element and the other end receiving a first voltage, thereby providing a CPU core voltage. The load resistor has both ends respectively connected to a high voltage and the power element. The over-current comparator has a reference input end receiving the second reference voltage and the other two input ends respectively connected to the both ends of the load resistor for detecting a voltage drop across the load resistor. The over-current comparator compares the voltage drop with the second reference voltage. If the voltage drop is greater than the second reference voltage, the output end of the over-current comparator outputs an over-current signal to the control transistor so as to control transmission of the first reference voltage to the differential operation amplifier.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

As previously described, the systematic companies have no choice but to comply with the stringent voltage specifications provided by the CPU manufacturers. Conventionally, the CPU core voltage switching circuit is an only way to provide the desired working voltage to the CPU platform. On the contrary, the present invention provides another alternative to provide the desired working voltage to the CPU platform. In comparison with the CPU core voltage switching circuit, the CPU core voltage supply circuit of the present invention can output a stable CPU core voltage in a simplified and cost-effective circuit configuration.

Figure 1:
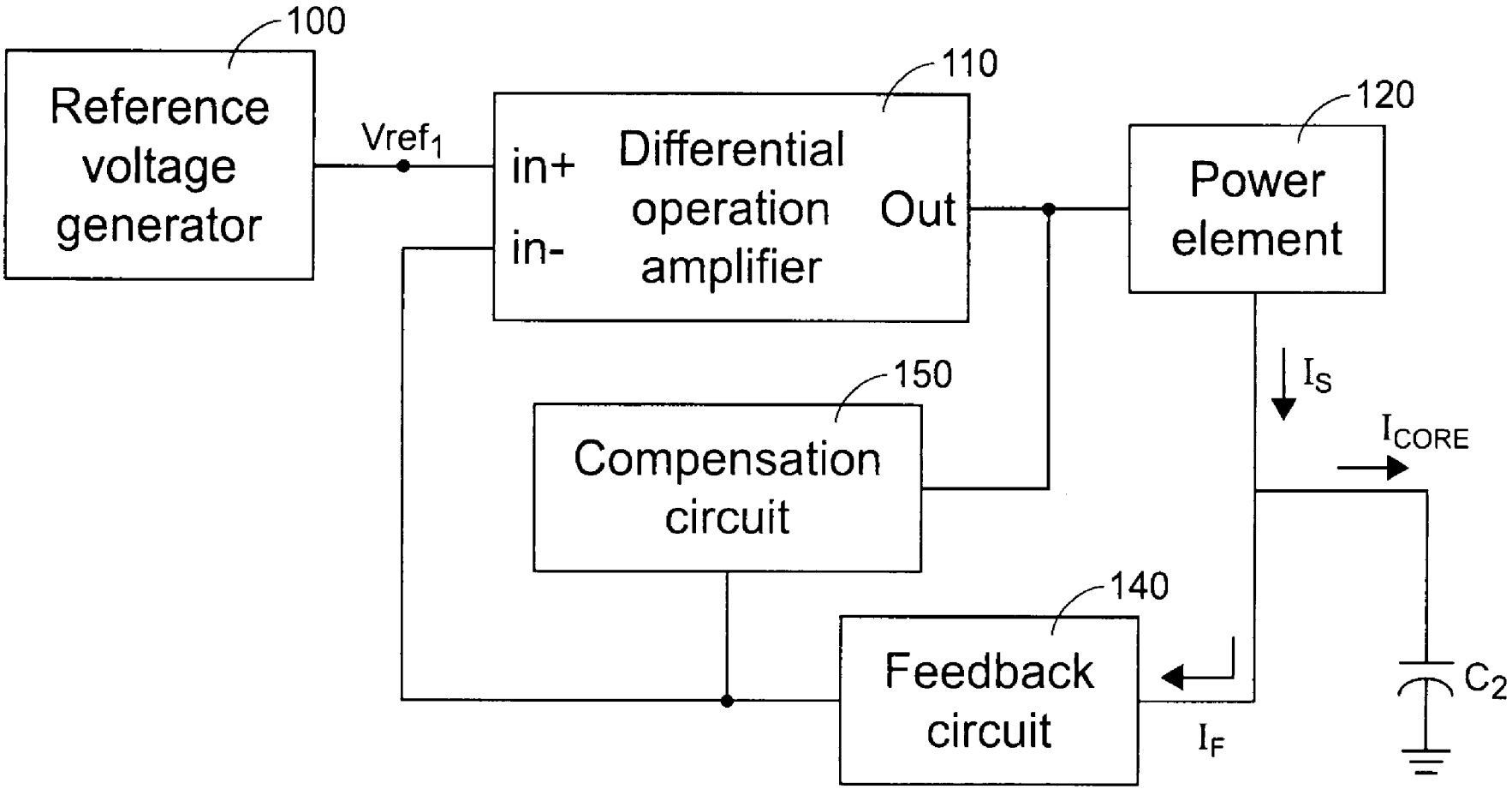
FIG. 1 is a schematic circuit block diagram illustrating a CPU core voltage supply circuit according to a preferred embodiment of the present invention.

The present invention provides a CPU core voltage supply circuit in order to obviate the drawbacks encountered from the prior art. FIG. 1 is a schematic circuit block diagram illustrating a CPU core voltage supply circuit according to a preferred embodiment of the present invention. The CPU core voltage supply circuit principally comprises a reference voltage generator 100, a differential operation amplifier 110, a power element 120, a feedback circuit 140 and a compensation circuit 150. The reference voltage generator 100 outputs a first reference voltage $V_{ref1}$ to a positive input end in+ of the differential operation amplifier 110. The negative input end in− of the differential operation amplifier 110 is connected to the feedback circuit 140 for receiving a feedback signal (or a feedback voltage) from the feedback circuit 140. A voltage difference between the first reference voltage $V_{ref1}$ and the feedback voltage is linearly amplified, and thus the differential operation amplifier 110 outputs a control voltage corresponding to the amplified voltage difference to the power element 120.

Figure 2A:
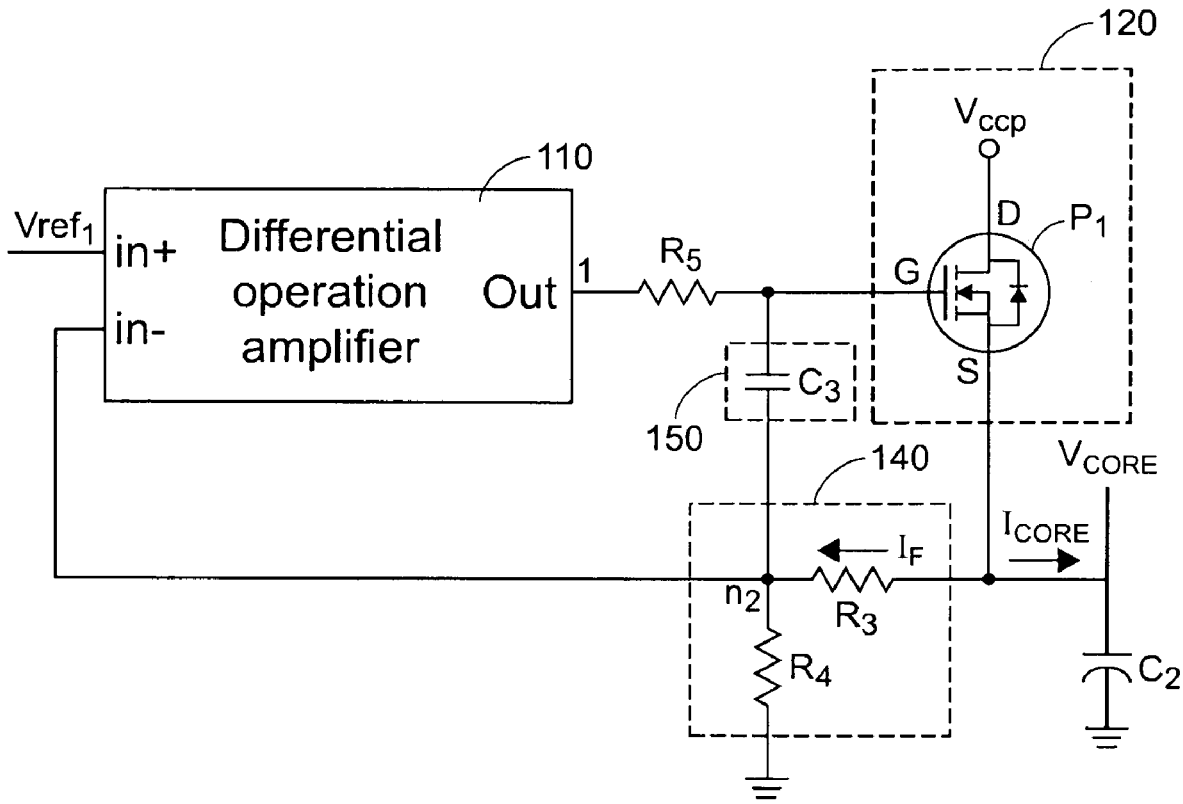
FIG. 2A is a schematic detailed circuit diagram illustrating the power element, the feedback circuit and the compensation circuit of the CPU core voltage supply circuit shown in FIG. 1.
Figure 2B:
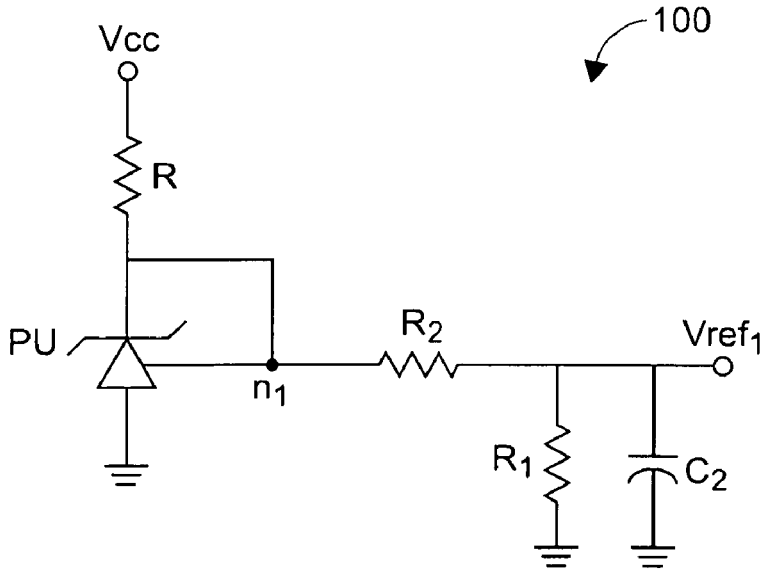
FIG. 2B is a schematic detailed circuit diagram illustrating the reference voltage generator of the CPU core voltage supply circuit shown in FIG. 1.

FIG. 2A is a schematic detailed circuit diagram illustrating the power element, the feedback circuit and the compensation circuit of the CPU core voltage supply circuit shown in FIG. 1. FIG. 2B is a schematic detailed circuit diagram illustrating the reference voltage generator of the CPU core voltage supply circuit shown in FIG. 1.

As shown in FIG. 2A, the power element 120 comprises a power transistor with three terminals. An exemplary power element 120 includes but is not limited to a metal oxide semiconductor field effect transistor (MOSFET), a bipolar junction transistor (BJT) or an insulated gate bipolar transistor (IGBT). In the embodiment of FIG. 2A, the power element 120 is an N-type MOSFET $P_1$. The N-type MOSFET $P_1$ has a gate terminal G, a drain terminal D and a source terminal S. The gate terminal G is connected to an output end of the differential operation amplifier 110 for receiving the control voltage from the differential operation amplifier 110. The drain terminal D receives a high voltage $V_{ccp}$. The source terminal S is connected to the feedback circuit 140 and an end of a capacitor $C_2$. The power element 120 outputs a source current $I_S$. By current division, the source current $I_S$ is split into a core current $I_{CORE}$ and a feedback current $I_F$. That is, $I_S=I_{CORE}+I_F$. The core current $I_{CORE}$ flows into the capacitor $C_2$ to charge the capacitor $C_2$ and thus a CPU core voltage $V_{CORE}$ is created across the capacitor $C_2$. After the feedback current $I_F$ passes through the feedback circuit 140, the feedback circuit 140 issues a feedback voltage to the negative input end in− of the differential operation amplifier 110. According to the voltage difference between the first reference voltage $V_{ref1}$ and the feedback voltage, the differential operation amplifier 110 outputs an adjusted control voltage to the power element 120. According to the adjusted control voltage, the magnitude of the source current $I_S$ is changed so as to output a stable core current $I_{CORE}$ and establish a stable CPU core voltage $V_{CORE}$.

In the above embodiment, the power element 120 is illustrated by referring to a power transistor. Nevertheless, the function of the power element 120 may be implemented by a variable resistor. According to the control voltage transmitted from the differential operation amplifier 110, the variable resistor adaptively outputs the adjusted source current $I_S$ so as to output a stable core current $I_{CORE}$ and establish a stable CPU core voltage $V_{CORE}$.

Please refer to FIG. 2A again. The feedback circuit 140 comprises two resistors $R_3$ and $R_4$, which are connected in series. The resistor $R_3$ has an end receiving the feedback current $I_F$ and the other end connected to the resistor $R_4$. The other end of the resistor $R_4$ is connected to a low voltage (e.g. a ground voltage). These two resistors $R_3$ and $R_4$ are connected to a node $n_2$. By the serially-connected resistors $R_3$ and $R_4$, the feedback voltage is provided through voltage division. The compensation circuit 150 comprises a capacitor $C_3$. The capacitor $C_3$ is connected between the gate terminal of the power element 120 and the node $n_2$.

Please refer to FIG. 2B. The reference voltage generator 100 principally comprises a three terminal constant voltage regulator PU and two resistors $R_1$ and $R_2$. The resistors $R_1$ and $R_2$ are connected in series. The serially-connected resistors $R_1$ and $R_2$ has an end connected to a node $n_1$ and the other end connected to the ground terminal. The voltage regulator PU is used for generating a constant voltage. By the serially-connected resistors $R_1$ and $R_2$, the constant voltage is subject to voltage division so as to generate the first reference voltage $V_{ref1}$. Furthermore, the reference voltage generator 100 comprises a capacitor $C_1$, which is connected between the serially-connected resistors $R_1$ and $R_2$ and the ground terminal. The serially-connected resistors $R_1$ and $R_2$ and the capacitor $C_1$ collectively act as a low pass filter, thereby enhancing the performance. The three terminal constant voltage regulator PU is connected between a resistor R and the ground terminal. A high voltage $V_{cc}$ is dropped across the resistor R and then received by a negative electrode of the three terminal constant voltage regulator PU. Since the negative electrode of the three terminal constant voltage regulator PU is connected to a control terminal, the three terminal constant voltage regulator PU is a so-called shunt regulator exhibiting a function similar to a Zener diode. In a case that the Zener breakdown voltage of the three terminal constant voltage regulator PU is 2.5 volt, the potential at the node $n_1$ is 2.5 volt. Assuming the capacitance values of the resistors $R_1$ and $R_2$ are respectively 10 kOhm and 31.6 kOhm, the voltage across the resistor $R_1$ may be deduced as $2.5\ \text{volt}\times R_1/(R_1+R_2)=2.5\text{V}\times 10\ \text{kOhm}/(10\ \text{kOhm}+31.6\ \text{kOhm})=0.6$ volt. Meanwhile, the first reference voltage $V_{ref1}$ is 0.6 volt. According to the desired CPU core voltage $V_{CORE}$, the first reference voltage $V_{ref1}$ may be adjusted to 0.6 volt or other value.

The operations of the capacitor $C_2$ will be illustrated as follows. In a case that the voltage across the capacitor $C_2$ is insufficient (i.e. the CPU core voltage $V_{CORE}$ is low), the core current $I_{CORE}$ needs to be increased in order to charge the capacitor $C_2$ and increase the CPU core voltage $V_{CORE}$. Since $I_S=I_{CORE}+I_F$, the feedback current $I_F$ is decreased as the core current $I_{CORE}$ is increased. Under this circumstance, the magnitude of the feedback voltage generated by the feedback circuit 140 is reduced and thus the voltage difference between the first reference voltage $V_{ref1}$ and the feedback voltage is increased. According to the increased voltage difference, the differential operation amplifier 110 outputs a relatively larger control voltage to the power element 120. According to the larger control voltage, the power element 120 is controlled to linearly generate a larger source current $I_S$. Consequently, an increased core current $I_{CORE}$ is outputted to charge the capacitor $C_2$ so as to increase the CPU core voltage $V_{CORE}$ until the CPU core voltage $V_{CORE}$ reaches a normal level.

On the other hand, when the charge capacity of the capacitor $C_2$ reaches saturation, the core current $I_{CORE}$ needs to be decreased. Since $I_S=I_{CORE}+I_F$, the feedback current $I_F$ is increased as the core current $I_{CORE}$ is decreased. Under this circumstance, the magnitude of the feedback voltage generated by the feedback circuit 140 is raised and thus the voltage difference between the first reference voltage $V_{ref1}$ and the feedback voltage is reduced. According to the reduced voltage difference, the differential operation amplifier 110 outputs a relatively smaller control voltage to the power element 120. According to the smaller control voltage, the power element 120 is controlled to linearly generate a smaller source current $I_S$. Consequently, a smaller or no core current $I_{CORE}$ is outputted to charge the capacitor $C_2$ until the CPU core voltage $V_{CORE}$ reaches a normal level. From the above description, a stable CPU core voltage $V_{CORE}$ is adaptively adjusted by the CPU core voltage supply circuit of the present invention.

Figure 3:
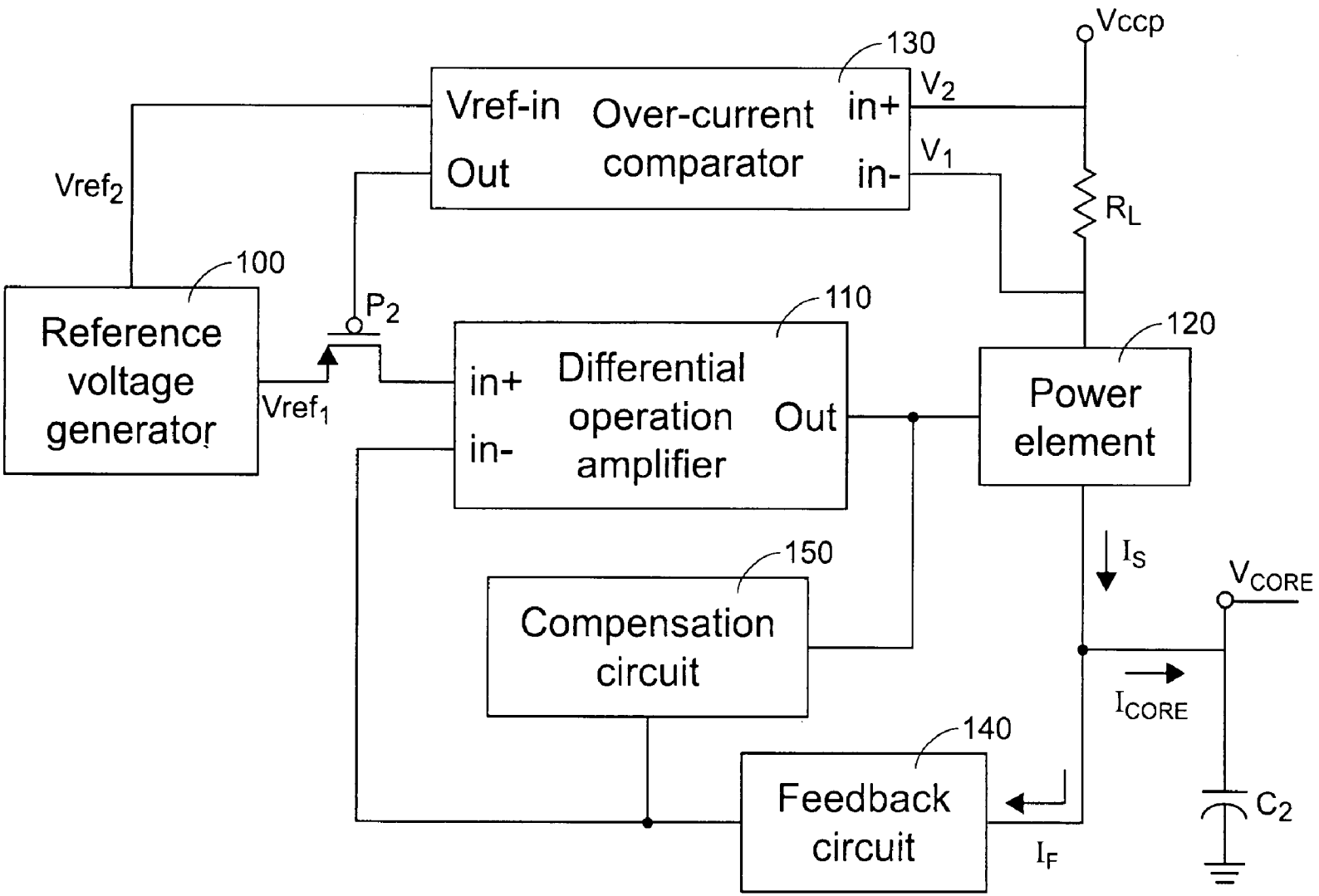
FIG. 3 is a schematic circuit block diagram illustrating a CPU core voltage supply circuit according to another preferred embodiment of the present invention.

For over-current protection of the CPU, the CPU core voltage supply circuit of the present invention may be modified. FIG. 3 is a schematic circuit block diagram illustrating a CPU core voltage supply circuit according to another preferred embodiment of the present invention. The CPU core voltage supply circuit of FIG. 3 principally comprises a reference voltage generator 100, a differential operation amplifier 110, a power element 120, a feedback circuit 140, a compensation circuit 150, and an over-current comparator 130. The operations of the differential operation amplifier 110, the power element 120, the feedback circuit 140 and the compensation circuit 150 included therein are similar to those shown in FIGS. 1 and 2, and are not redundantly described herein. In this embodiment, the reference voltage generator 100 also outputs a second reference voltage $V_{ref2}$ (e.g. 0.1 volt) to a reference input end Vref-in of the over-current comparator 130. In addition, a load resistor $R_L$ has an end connected to the power element 120 and the other end receiving the high voltage $V_{ccp}$. The other two input ends in+ and in− of the over-current comparator 130 are respectively connected to both ends of the load resistor $R_L$, thereby detecting a voltage drop $V_{RL}$ across the load resistor $R_L$, in which $V_{RL}=V_2-V_1$. The resistance of the load resistor $R_L$ is determined according to the maximum current allowing for passage to the CPU platform. As a consequence, the maximum voltage drop $V_{RL}$ across the load resistor $R_L$ will not exceed the second reference voltage $V_{ref2}$ so as to achieve the purpose of over-current protection.

Please refer to FIG. 3 again. A control transistor $P_2$ has three terminals connected to the reference voltage generator 100, the output end of the over-current comparator 130 and the positive input end in+ of the differential operation amplifier 110, respectively. In a case that the voltage drop $V_{RL}$ is greater than the second reference voltage $V_{ref2}$, the output end of the over-current comparator 130 outputs an over-current signal to the control transistor P2. In response to the over-current signal, the transmission of the first reference voltage $V_{ref1}$ from the reference voltage generator 100 to the differential operation amplifier 110 is controlled by the control transistor $P_2$. Take a PMOS as the control transistor $P_2$ for example. In response to the over-current signal, the control transistor $P_2$ is shut off and thus the control voltage is no longer received by the power transistor $P_1$. Under this circumstance, the power transistor $P_1$ is also shut off and thus no over-current will pass through the power transistor $P_1$ so as to protect other components.

From the above description, the CPU core voltage supply circuit has simplified circuit configuration without deteriorating the performance. Consequently, the CPU core voltage supply circuit is very cost-effectively. Since the CPU core voltage supply circuit linearly outputs a stable CPU core voltage in replace of using constant voltage switching circuit, the cost of the CPU core voltage supply circuit will be no longer dominated by the CPU manufacturers.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A CPU core voltage supply circuit comprising:

a reference voltage generator outputting a first reference voltage and a second reference voltage;

a control transistor having a first terminal receiving the first reference voltage;

a differential operation amplifier having a positive input end, a negative input end and an output end, wherein the positive input end of the differential operation amplifier is connected to a second terminal of the control transistor;

a power element having a receiving terminal and a current output terminal, wherein the receiving terminal of the power element is connected to the output end of the differential operation amplifier;

a feedback circuit connected to the current output terminal of the power element and outputting a feedback voltage to the negative input end of the differential operation amplifier;

a first capacitor having an end connected to the current output terminal of the power element and the other end receiving a first voltage, thereby providing a CPU core voltage;

a load resistor having both ends respectively connected to a high voltage and the power element; and an over-current comparator having a reference input end receiving the second reference voltage and another two input ends respectively connected to the both ends of the load resistor for detecting a voltage drop across the load resistor, wherein the over-current comparator compares the voltage drop with the second reference voltage, and if the voltage drop is greater than the second reference voltage, the output end of the over-current comparator outputs an over-current signal to the control transistor so as to control transmission of the first reference voltage to the differential operation amplifier.

2. The CPU core voltage supply circuit according to claim 1 further comprising a compensation circuit, which has an end connected to the negative input end of the differential operation amplifier and the other end connected to the output end of the differential operation amplifier.

3. The CPU core voltage supply circuit according to claim 2 wherein the compensation circuit comprises a second capacitor.

4. The CPU core voltage supply circuit according to claim 1 wherein the feedback circuit comprises two serially-connected resistors, and the feedback voltage is provided through voltage division by the two serially-connected resistors.

5. The CPU core voltage supply circuit according to claim 1 wherein the reference voltage generator comprises:

a voltage regulator for providing a constant voltage; and two serially-connected resistors connected between the voltage regulator and the ground terminal, wherein the constant voltage is subject to voltage division by the serially-connected resistors, thereby generating the first reference voltage.

6. The CPU core voltage supply circuit according to claim 5 wherein the voltage regulator is a shunt regulator.

7. The CPU core voltage supply circuit according to claim 5 wherein the power element is a power transistor.

8. The CPU core voltage supply circuit according to claim 1 wherein the power element is a variable resistor.

* * * * *